United States Patent [19]

Fillod et al.

[11] Patent Number: 4,545,475

[45] Date of Patent: Oct. 8, 1985

[54] SECURE COIN COLLECTION DEVICE FOR PRE-PAYMENT MACHINE

[75] Inventors: Maurice Fillod, Besancon; Jean-Francois Larriere, Genuille, both of France

[73] Assignee: Flonic S.A., Montrouge, France

[21] Appl. No.: 554,429

[22] Filed: Nov. 22, 1983

Related U.S. Application Data

[63] Continuation-in-part of Ser. No. 271,332, Jun. 8, 1981, abandoned.

[30] Foreign Application Priority Data

Jun. 11, 1980 [FR] France ..... 80 12934

[51] Int. Cl.[4] ..... G07F 9/06

[52] U.S. Cl. ..... 194/1 B; 232/15; 232/43.1

[58] Field of Search ..... 194/1 A, 1 B; 232/15, 232/16, 31, 32, 43.2, 43.1, 43.5

[56] References Cited

U.S. PATENT DOCUMENTS

| | | | |
|---|---|---|---|
| 2,113,989 | 4/1938 | Klemt | 194/1 B X |
| 2,783,937 | 3/1957 | Hudson | 232/16 X |
| 2,869,778 | 1/1959 | Share | 232/16 |
| 2,992,771 | 7/1961 | McClung | 232/16 |
| 3,074,626 | 1/1963 | Lewis | 232/16 |
| 3,455,503 | 7/1969 | Coffield | 232/15 X |
| 3,677,461 | 7/1972 | Nitschneider et al. | 232/15 |
| 3,807,627 | 4/1974 | Nitschneider | 232/15 |
| 3,938,733 | 2/1976 | Weber et al. | 232/16 |

FOREIGN PATENT DOCUMENTS 747078 3/1956 United Kingdom .

*Primary Examiner*—F. J. Bartuska
*Attorney, Agent, or Firm*—Dale Gaudier

[57] ABSTRACT

A pre-payment machine includes a strong-box intended for temporarily storing coins introduced into the machine prior to their collection by means of a connected collection device, this strong-box being especially designed in order to be protected against break-ins. The strong-box is made up of two sections: the first is a receptacle which forms an integral part of the housing itself of the machine and has a collection aperture usually closed by a seal; and the other is a lid secured to the receptacle by means controlled by the seal and disposed substantially within the receptacle. In one embodiment the securing means is a pin which engages the lid and the seal when in its closed position. In a second embodiment the securing means is one or more tabs formed integral with the slide which engage openings formed in a part of the lid, and one or more tabs formed integral with a part of the lid which engage openings formed in the bottom of the receptacle when the seal is in its closed position. The seal can only be maneuvered in the open position by coupling the collection device with the housing of the machine.

20 Claims, 18 Drawing Figures

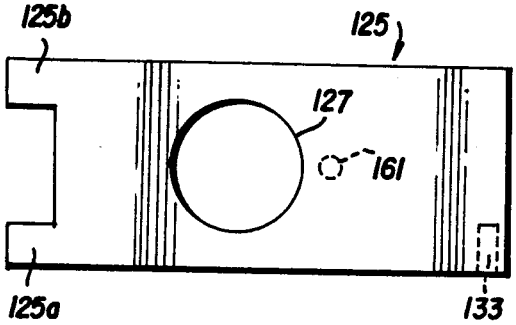
FIG. 17
FIG. 18
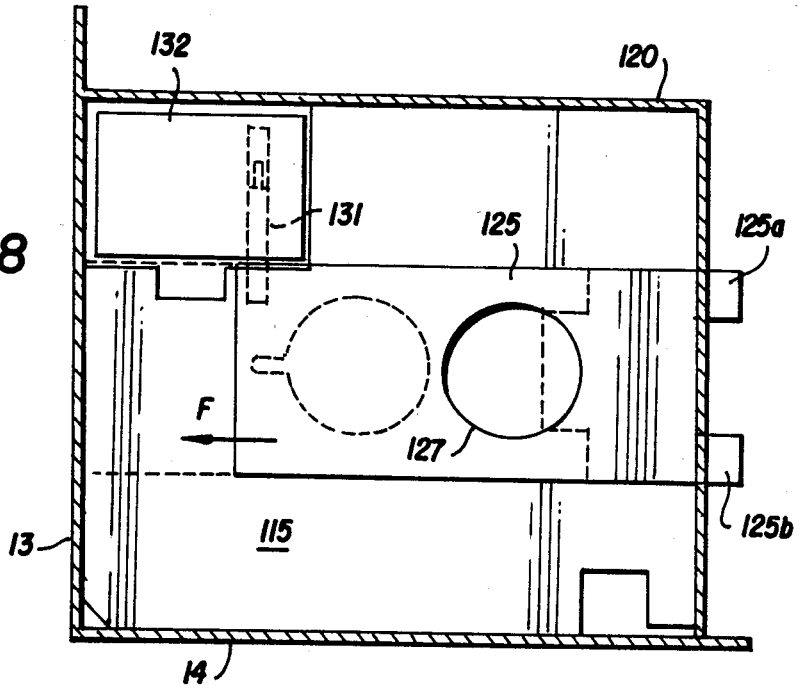

SECURE COIN COLLECTION DEVICE FOR PRE-PAYMENT MACHINE

CROSS-REFERENCE TO RELATED APPLICATIONS

This application is a continuation-in-part of application Ser. No. 271,332, filed June 8, 1981 now abandoned.

BACKGROUND OF THE INVENTION

1. Field of the Invention

The present invention relates to machines for distributing objects or for obtaining pre-payment services, and to a connected collection device allowing the coins collected in payment of the former to be periodically collected and stored temporarily in the machines.

2. Description of the Prior Art

Vending machines of this type are used for example for the issue of various objects (food, stamps, tickets, etc . . . . ), or for obtaining services (right of way, road tax, etc . . . . ), in exchange for coins. A more specialized application concerns machines issuing parking tickets intended to be attached to the windshield of vehicles in certain urban paying parking zones.

The pre-payment distribution machines generally comprise, in a fixed housing on a support embedded in the ground, means to evaluate the coins introduced into the machine by the user, means for distributing objects in terms of the sum introduced, and a strong-box or money-box, into which are fed the coins having caused the distribution of the objects. The sums thus collected in the strong-box of a machine are periodically collected by a member of staff charged with this collection operation.

The housings of the strong-boxes ensuring the temporary storage of coins in the machine can be classified into two main types. A first type consists of providing the machine with a removable strong-box, accessible to the collecting staff through a reinforced and locked door, in order to be replaced by an empty strong-box. The strong-box itself has a lockable door, the key for which is not available to the collecting staff on site. Another type consists of using a strong-box, semi-movable but connected to the machine, which may be tilted after opening a door to the machine which is locked and giving access to this strong-box. The strong-box in the tilted position is thus coupled to the head of a collection device by maneuvering one or more keys. This device comprises, in addition, a tube connecting the collection head to a collection strong-box mounted on a mobile carriage into which the coins fall by gravity and where they are inaccessible to the collection staff.

In the individual case of vending machines of parking tickets, these machines are of course installed on the public highway and consequently, are more and more frequently the object of burglaries and break-in attempts for the sums contained in their strong-boxes when they are not under surveillance at night.

In fact, in the first type of machine mentioned earlier wherein the strong-box is removable, protection against theft is ensured only by a door which after being forced, gives free access to the strong-box. The latter is then taken away by the wrong-doers to be emptied at leisure elsewhere. In the other type of machine mentioned, protection is principally ensured, in addition to the access door, by the fact that the strong-box is immovable and consequently must be forced open on the spot.

In practice, it has been observed that this protection was quite illusory and that once the door had been forced open, the strong-box was in turn cut away from its support by means of simple tools, such as a chisel and a crow-bar, then taken away as in the first case.

SUMMARY OF THE INVENTION

The invention thus relates to a vending machine and a connected collection device which do not have the disadvantages which have just been listed and in which really effective protection against theft is provided to make the strong-box immovable, inviolable and inaccessible unless having been first emptied.

The vending machine according to the invention comprises, in a single housing, means to evaluate the coins, means to distribute objects or authorizations of access for obtaining services, a strong-box for the temporary storage of the coins collected by the machine before their transfer into a collection device connected to the machine, a section of the strong-box being made up of the housing itself and having a collection aperture normally closed by a seal, the seal being maneuverable only by coupling the head of the collection device directly onto the housing, and characterized in that the strong-box is composed of a bottom forming an integral part of the housing and by a lid secured to the bottom by locking means controlled by the seal and disposed within the strong-box.

The design of the machine is such that the strong-box is in part composed of the housing of the machine means such that it cannot be removed unless the whole machine is removed after being detached from its support; neither can the strong-box be dismantled, since the lid forming the other part of its enclosure is locked onto the housing by the seal of the collection aperture, and this seal cannot be maneuvered into position unless the head of the collection device is itself coupled to the machine housing.

Thus it is understood that even in the case where the service door of the machine giving access to the internal functional parts (coiner, dispenser, etc . . . . ) is forced by offenders, the latter will find it impossible to force the strong-box itself. The thickness of the steel forming the housing and its lid may in fact be suitable dimensioned, for example by choosing a sheet 4 mm thick, in order to make the strong-box inviolable to the mechanical tools generally used in this type of break-in.

The strong-box being protected against an attack on the machine from he outside in this way, is also protected against an attack from the interior. In fact, if an attempt is made to burgle the interior of the strong-box by trying to disengage the collection aperture, this aperture is closed by the seal which is normally locked into position by a double bolt: first, by means of a lock, useable by the collection staff in conjunction with the head of the collection device; and second, by means of a second spring-bolt which can only be freed by coupling with the head of the collection device.

In other words, even when in possession of the key to the lock, it is still indispensable to possess at least one head for the collection device in order to succeed in unbolting the seal and take possession of the money inside the strong-box.

BRIEF DESCRIPTION OF THE DRAWING FIGURES

Other characteristics and advantages of the invention will emerge from the description which will follow in relation to the attached drawings. In these drawings:

FIG. 17 is a plan view of a second embodiment of a seal for the strong-box of FIGS. 13–15.

FIG. 18 is a view from above of the strong-box of FIGS. 13–15 with the lid removed.

DESCRIPTION OF THE PREFERRED EMBODIMENTS

Examples of two embodiments of the invention applied to a pre-payment machine intended for the distribution of parking tickets will now be described, given that the invention is not limited to this single application, and may be used for vending machines for any kind of object or for those allowing any kind of service to be obtained.

Figure 3:
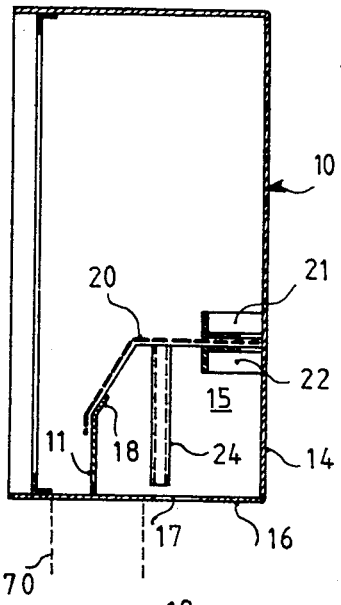
FIGS. 1 to 3 are views illustrating a first arrangement of the strong-box in the housing of the machine, in horizontal cross-section according to planes 2—2 and 3—3 respectively.
Figure 2:
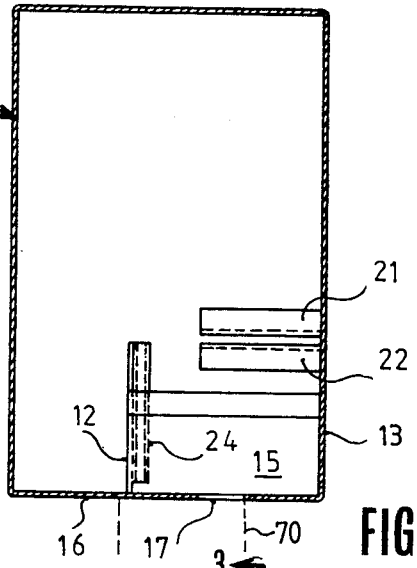
Figure 1:
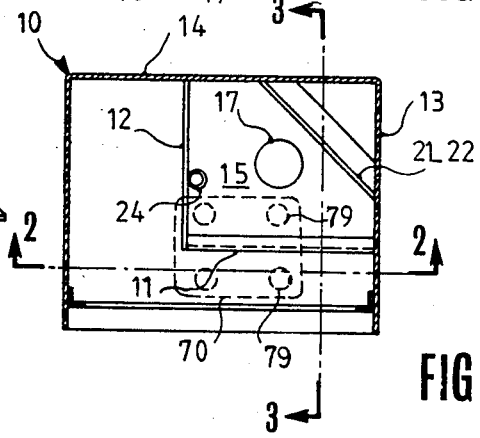

With reference to FIGS. 1–3, in a first embodiment of the invention the housing 10 of the machine, which is of general parallelpiped shaped, is closed on its front surface by a service door (not shown) on which are arranged various elements (slots for insertion of the coins, device for posting the sums introduced, and corresponding parking times, issue of tickets, etc . . . . ) co-operating with the internal functional parts of the machine which can include such things as means for evaluating the coins, a clock, means for calculating time, a ticket printer, etc (not shown).

The housing 10 is composed of a welded steel sheet and comprises, in addition to the external walls, two internal vertical partitions 11 and 12, also welded to the housing, the partition 11 being parallel to the front door, the partition 12 being perpendicular to the latter so as to form with the corresponding external walls, the lateral wall 13 and the rear wall 14, the bottom of a receptacle 15 intended to serve partially as a strong-box for the machine and to receive the coins introduced in exchange for the distribution of tickets.

Figure 4:
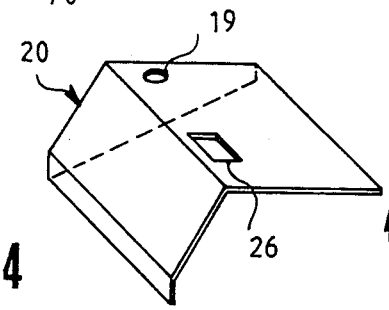
FIG. 4 is a perspective view of a first embodiment of a lid for the strong-box shown in FIGS. 1–3.
Figure 5:
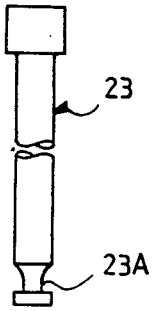
FIG. 5 is a view of the pin bolting the strong-box lid shown in FIG. 4.

In the lower wall 16 of the housing 10, there is provided an aperture 17, for example circular in shape, which can be seen in FIGS. 2 and 3, for the collection of coins thus collected in the machine, this aperture being arranged approximately in the center of the bottom of the receptacle 15. The wall 11 has a slightly sloping rim 18. Receptacle 15 is arranged in order to receive an lid 20, with three flat surfaces provided with a rim at the side of the partition 12, shown in perspective in the view in FIG. 4, so as to form with the receptacle 15 a closed container forming the strong-box of the machine. The housing 10 of the machine is fixed on a vertical pillar 70 by means of bolts 79, certain of which are situated inside the section 15. In order to maintain the lid 20 in place, edge stays 21, 22 are welded on the inside onto the respective walls 13 and 14. In addition, the lid 20 may be bolted onto the bottom of receptacle 15 by means of a pin with a wide head (FIG. 5) passing through the lid through a hole 19 and passing inside a guide tube 24 welded onto the partition 12, this locking being ensured, as will be explained subsequently, by means of a seal 25 (FIG. 6) closing the locking aperture 17. With the exception of a slot 26 for the insertion of coins coming from the evaluation means, and from the aperture 17, the strong-box formed by the bottom 115 and the lid 20 once assembled does not have any other aperture.

Figure 6:
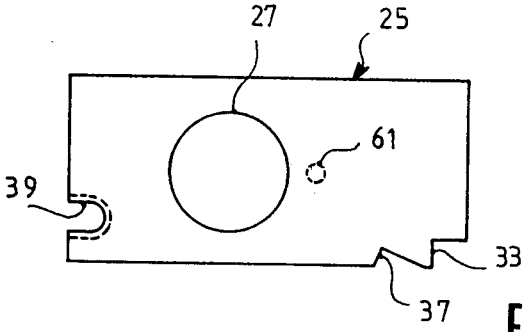
FIG. 6 is a plan view of a first embodiment of a seal for the strong-box of FIGS. 1–3.

The collection aperture 17 at the bottom of the receptacle 15 is normally closed (that is to say, except during the collection operation) by the seal 25, illustrated in a plan view in FIG. 6, which is composed of a mobile slide having an opening 27 of the same dimensions as the aperture 17. The opening 27 may be shifted to coincide with the aperture 17 by maneuvering the slide 25 into positions which will be explained in detail later, in order to allow the coins to pass from the strong-box of the machine into the collection device.

Figure 7:
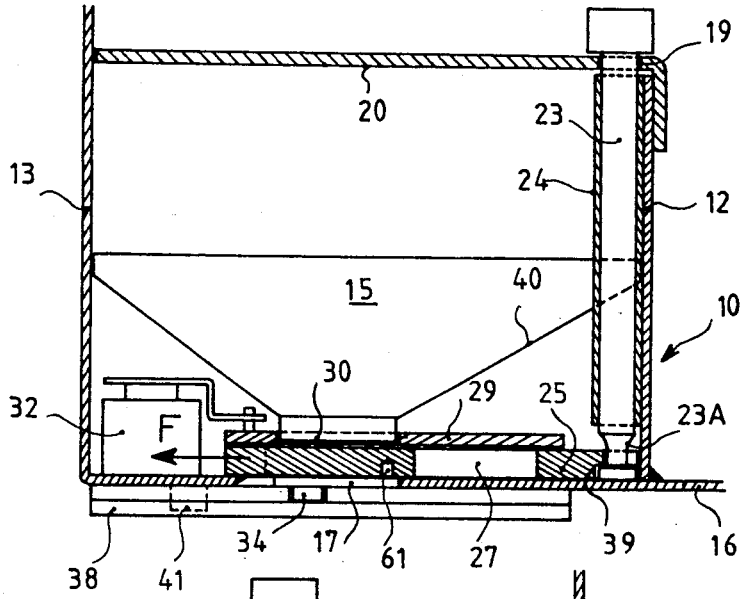
FIGS. 7 and 8 are views in profile and in cross-section of the strong-box equipped with its bolting mechanism.
Figure 8:
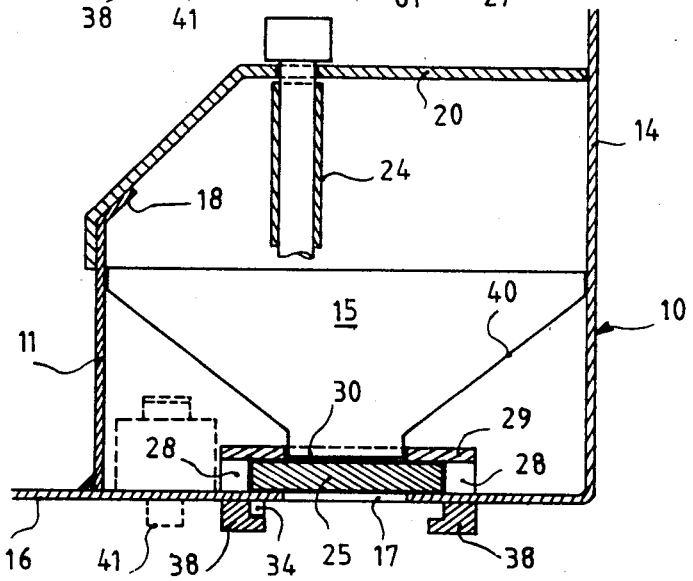

FIGS. 7 and 8 show the strong-box assembled and with its locking mechanism in the closed position respectively, in section according to two lines 7—7 and 8—8 (see FIG. 9) parallel to the wall 13 and 14 and passing through the center of the collection aperture 17.

Figure 9:
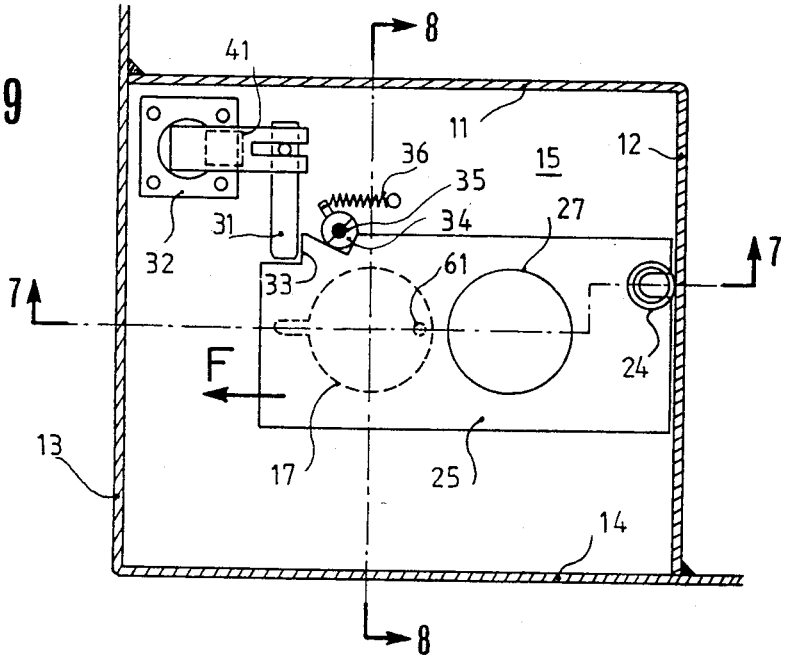
FIG. 9 is a view from above of the preceding strong-box, with the lid removed.

FIG. 9 illustrates the bottom of the receptacle 15 seen from above revealing the slide 25 in the closed position. The latter is engaged against the lower wall 16 of the housing 10 by an assembly of lateral grooves 28 and by a counterplate 29 screwed onto the wall 16. The counterplate 29 also has an opening 30 of slightly smaller dimensions and in coincidence with the aperture 17. The slide 25 may however slide longitudinally in accordance with the direction indicated by the arrow F, when it is not bolted into the locking position, so that its opening 27 becomes coincident with the two other openings 17 and 30.

Under the wall 16, outside the housing 10, there are also fixed grooves 38 (FIG. 8) for guiding the head of the collection device under the aperture 17.

The bolting of the slide 25 is ensured first, by the bolt 31 of a lock 32 which, in the closed position, comes to rest against a shoulder block 33 of the slide (FIG. 6), and secondly, by an auxiliary bolt 34, made up of a half-disk 34; this bolt 34 may pivot about an axis 35 and normally projects, under the action of a return spring 26, into one of the grooves 38 and into a notch 37 of complementary shape on the lateral edge of the slide so that even when it is not blocked by the bolt 31 of the lock 32, the slide is still immobilized in the locked position by this auxiliary bolt 34. The unbolting or withdrawal of this bolt 34 in opposition to the spring 36 can only be obtained by introducing the head 50 (FIGS. 10 to 12) of the collection device into the grooves 38, which thus has the effect of causing the bolt to turn a hundred degrees in a counterclockwise direction and to disengage it from the notch 37, thus freeing the slide 25.

As indicated previously, the slide 25 has as a joint function, when it is in the closed position of the aperture 17, the bolting of the lid 20 onto the bottom 15 by means of the pin 23; to this end, the slide has another notch 39 at its opposite end in the direction of the arrow F, the notch 39 engaging with a groove 23A (FIG. 4) fashioned at the lower end of the pin 23 in the manner of a cottering, so that in the closed position of the slide, it is not possible to remove the lid 20 in order to gain access to the interior of the strong-box, even from the interior of the machine after having opened the service door.

Once the double bolting mechanism of the slide 25 is mounted in the bottom of the receptacle 15, the latter is fitted with a funnel 40 in the shape of an inverted pyramid in order to channel the coins stored in the strong-box towards the collection aperture 17, the mouthpiece of this funnel resting on the corresponding opening 30 of the counter-plate 29.

Figure 11:
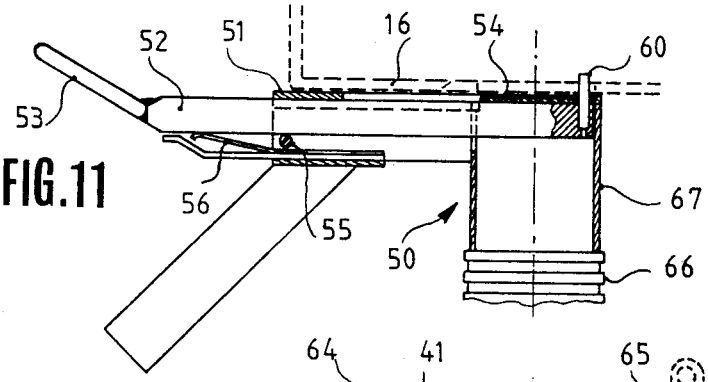
FIGS. 10–12 illustrate a plan view and in section the head of the collection device co-operating with the machine in the previous figures.
Figure 10:
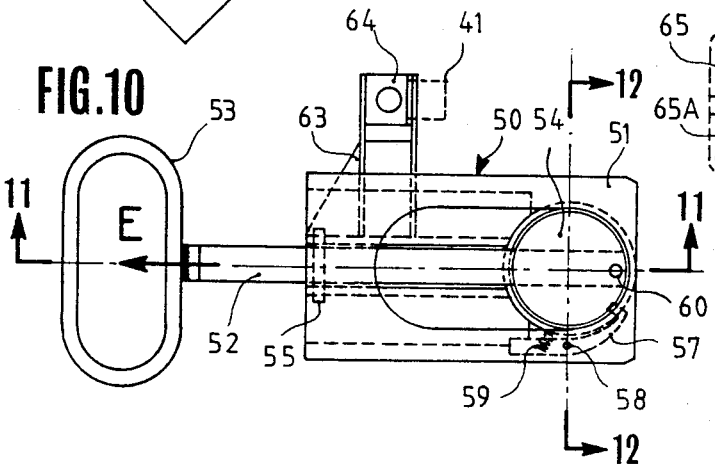
Figure 12:
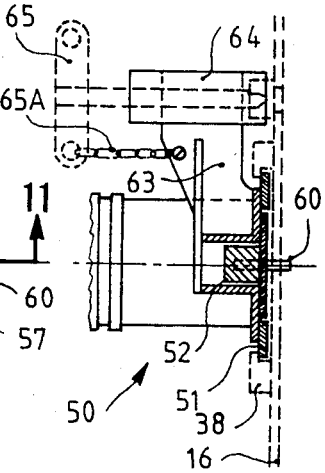

The head of the collection device allowing the slide to be maneuvered from the outside of the housing 10 of the machine will now be described. With reference to FIGS. 10, 11 and 12 which illustrate the head 50 in plan view and in section along planes 11—11 and 12—12, the head 50 comprises a frame 51 the width of which corresponds to the gap between the exterior grooves 38 of the housing 10 so as to be able to be engaged between the latter. The frame 51 is hollowed out in the interior and supports a drawer 52 having at one end a control handle 53 and at the other end a seal in the form of a circular disk 54, substantially of the same dimensions as the collection aperture 17. The seal 54 closes a cylindrical and concentric section 67, integral with the frame 51. The drawer 52 rests on an axis 55, so as to be able to push a leaf spring 56 longitudinally, acting in order to maintain it in an oblique position in relation to the plane of the frame 51. The seal 54 is maintained normally in this oblique position by a lever 57, mounted on the frame 51, pivoting about an axis 58 and pushed under the action of a spring 59 which prevents the drawer 52 and the seal 54 from coming into the plane of the frame 51. It is only when the head 50 in introduced into the grooves 38 that the lever 57, pushed back by the adjacent slide 38, pivots and is drawn aside in order to let the seal 54 come into the horizontal position when pressure is applied to the handle 53.

The seal 54 has a movable stop 60 which, when the seal 54 is brought into the horizontal position, may engage a corresponding housing 61 provided in the slide 25. The engagement of the stop 60 into this housing thus allows, by acting on the drawer 52, the slide 25 to be maneuvered from the outside of the machine, on condition of course that this latter is unbolted. The frame 51 also has a bracket 63 onto which is mounted a barrel 64 serving to retain a key 65 intended to activate the lock 32 of the strong-box. The key 65 is usually connected to the bracket 63 by a leaden attachment 65A sufficiently short to prevent its disengagement from the barrel 64.

This solution is adopted in the case where machine locks in a car park all have the same combination, which implies a vast storage strong-box in order to hold the heads of the collection devices with their keys outside the periods of collection and to prevent fraudulent collections.

In another case where the locks of machines have different combinations according to the roads or parking lots, the key is left immovable, which allows any collection device and key to be connected and to store the keys in a strong-box in order to prevent their theft or reproduction.

In addition, the head 50 may also comprise an "untamping" rod mounted on a swivel joint and allowing the inside of the strong-box to be reached by sliding, when the collection aperture is open, in order to move and cause the coins to drop which have a natural tendency to form an obstruction and seal this aperture themselves.

FIGS. 13–18 show a second embodiment of the invention in which an alternative arrangement for securing the lid of the strong-box to the housing is shown. Similar reference numerals indicate items similar to those shown in FIGS. 1–12.

Figure 13:
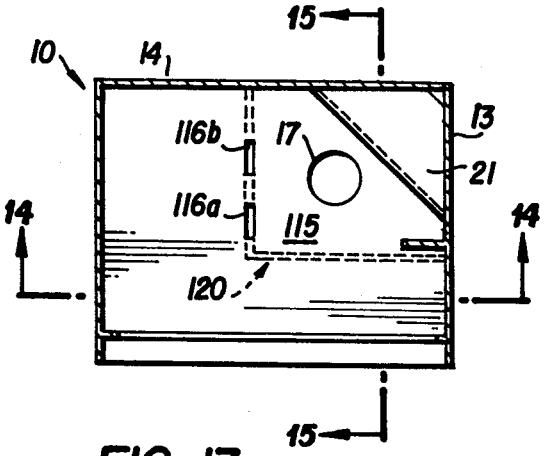
FIGS. 13–15 are views illustrating a second arrangement of the strong-box in the housing of the machine, in horizontal cross-section according to planes 14—14 and 15—15 respectively.
Figure 14:
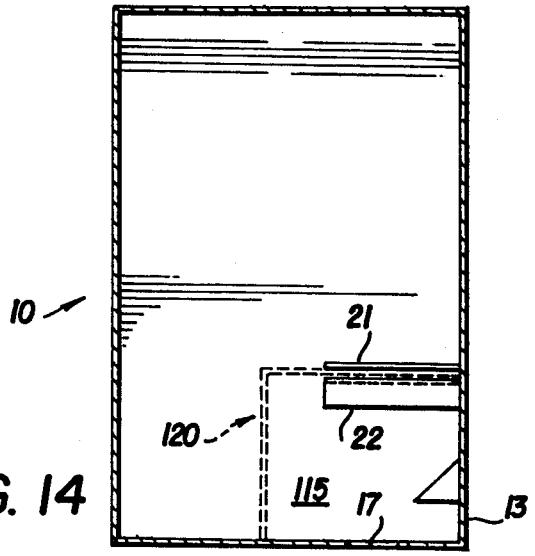
Figure 15:
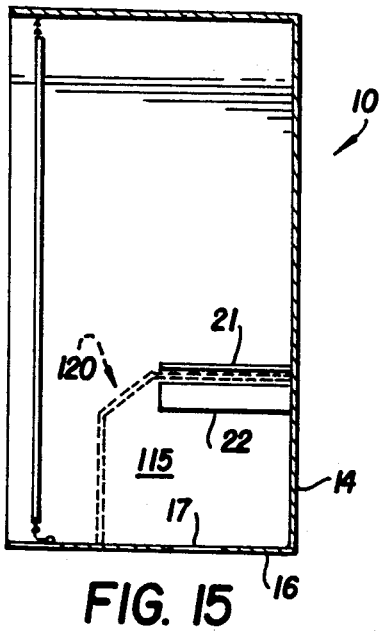

As shown in FIGS. 13–15, housing 10 includes walls 13, 14, and 16, with aperture 17 formed in lower wall 16. Walls 13 and 14 support a pair of edge stays 21 and 22 which are designed to receive a portion of lid 120, which is a modified version of lid 20 shown in FIG. 4.

Figure 16:
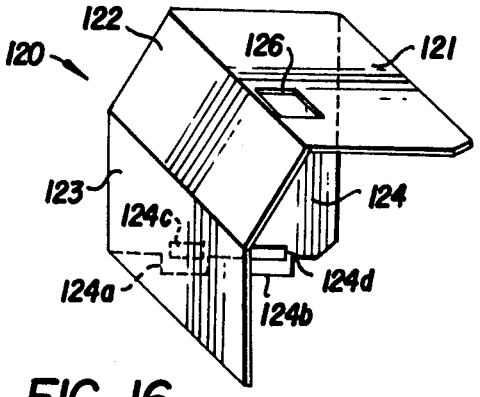
FIG. 16 is a perspective view of a second embodiment of a lid for the strong-box shown in FIGS. 13–15.

In particular, lid 120 includes a top 121, an angled face 122, a front 123 and a side wall 124 which together roughly form the three sides of a box as shown in FIG. 16. Lid 120 may be formed as a solid piece, such as by forging or casting, or from two or more pieces welded together. Top 121 includes a slot 126 which functions similarly to slot 26 of lid 20 shown in FIG. 4.

Side wall 124 of lid 120 includes a pair of tabs **124*a* and 124*b* formed integral with the side wall and extending downwardly therefrom. A pair of openings 124*c* and 124*d* are also formed in side wall 124 above tabs 124*a* and 124*b***.

As shown in FIG. 13, housing 10 includes a pair of openings **116*a* and 116*b* formed in lower wall 16. Openings 116*a* and 116*b* are designed to receive tabs 124*a* and 124*b* of lid 120 when lid 120 is placed in housing 10 so as to cover aperture 17. In this position top 121 of lid 120 will be disposed, in part, between edge stays 21 and 22. Thus tabs 124*a* and 124*b* cooperate with openings 116*a* and 116*b* to securely locate lid 120 in position in housing 10. When mounted like this in housing 10, the walls of lid 120 and walls 13, 14 and 16 of housing 10 form a receptacle 115**.

Lid 120 is secured to the housing by means of slide 125, which is a modified version of slide 25. Instead of having a notch for engaging a pin (such as 23 shown in FIG. 5) which secures the lid to the housing, slide 125 has a pair of tabs **125*a* and 125*b* formed integral therewith which engages openings 124*c* and 124*d* of lid 120 when slide 125 is in the closed position (see FIG. 18) to thereby secure lid 120 in housing 10 in a position covering receptacle 115. Slide 125 also includes an opening 127 and housing 161, similar in form and function to opening 27 and housing 61, respectively, of slide 25 (FIG. 6). Although not shown in FIG. 18, lower wall 16 of housing 10 is provided with grooves 28 and counter-plate 29 (as shown in FIGS. 7 and 8) between which slide 125 is disposed in a fashion similar to that described earlier with respect to slide 25. As in the first embodiment, a funnel, such as that shown at 40 in FIGS. 7 and 8, can be fitted over slide 125 to direct coins from a receptacle 115 through aperture 17 when slide 125** is in its open position.

Slide 125 includes an opening 133 for receiving a bolt 131 when the slide is in its closed position, as shown in FIG. 18. Bolt 131 is connected to a lock 132 which functions similarly to lock 32, described above with respect to FIG. 9. Obviously, opening 133 in slide 125 can be changed to a notch similar to 33 shown in FIGS. 6 and 9. Although not shown, an auxiliary locking mechanism such as shown at 34–36 in FIG. 9 can be employed with slide 125 if the slide is modified to include a notch similar to that shown at 37 in FIG. 6.

It will be appreciated that when slide 125 is in its closed position with tabs 125*a* and 125*b* engaging openings 124*c* and 124*d* of lid 120, and tabs 124*a* and 124*b* of lid 120 engaging openings 116*a* and 116*b* in lower wall 16 of housing 10, the lid is securely held to the housing by this interlocking arrangement of tabs and openings. Top 121 of lid 120 is also securely located by edge stays 21 and 22. Thus, the securing of the lid to the housing is accomplished by elements which are integral with, and disposed inside, receptacle 115, so that these elements are not subject to outside attack. Moreover, the lid may be released through the use of collection head 50, as described above with respect to FIGS. 10–12.

The structure of the machine having been described, it will now be explained how a collection operation is undertaken by a skilled member of staff, that is to say fitted with a collection device corresponding to this type of machine and provided with the key corresponding to the lock 32 or 132. The collection head 50 is first introduced into grooves 38 under the wall 16, which has the effect of freeing the auxiliary bolt 34 from side 25 or 125. The key 65 introduced into the barrel 64 allows the lock 32 or 132 to be activated and the bolt 31 or 131 to be withdrawn, which completely frees the slide 25 or 125. The thorough introduction of the head 50 into the grooves 38 having moreover pushed back the lever 57, the drawer 52 may be tilted manually into the horizontal position be pressing the handle 53 and consequently introducing the stop 60 into the housing 61 or 161 of the slide. By pulling on the handle 53 towards the exterior of the machine, the slide 25 or 125 attached to the stop 60 of the seal 54 is thus displaced according to the direction indicated by the arrow F and, at the end of its path, has its opening 27 or 127 coincident with the collection aperture 17 and the opening 30 of the counterplate 29, thus allowing the coins accumulated above the funnel 40 of the strong-box of the machine to fall by gravity into the mobile strong-box of the collection device, via the tube 66, through the opening disengaged by the seal 54 in the frame 51.

It is to be noted that the strong-box constructed in accordance with the invention offers maximum security against break-in attempts suffered by this type of machine and against fraud attempts. In fact, its steel sheet structure makes it practically inviolable by mechanical tools, the collection aperture, chosen with relatively small dimensions and sealed by the slide which may be of a suitable thickness, does not present an area of low resistance. A shifting of the slide is, as has been described, impossible unless the key to the lock and a collection head to operate its unlocking are provided. As to an attack on the strong-box from the interior of the machine after breaking open the service door, it is also been seen from the first embodiment of the invention that it is impossible to remove the lid 20, maintained on the bottom by the pin 23 (FIG. 4) so long as the slide locking this pin itself has not been removed. In the second embodiment of the invention, the lid 120 can be removed only when slide 125 is moved to its open position (dashed outline in FIG. 18) so tht tabs 125*a* and 125*b* of slide 125 no longer engage openings 124*c* and 124*d* of slide 120.

Moreover this provides additional security only making the interior of the strong-box and its securing mechanism available when its contents have been transferred into the collection device, since it is necessary to carry out a prior collection operation in order to release the lid.

Another security measure consists in preventing the use of the key 65 when the latter is inserted onto the head of the collection device, as has been previously indicated, without the head having been introduced into the grooves under the collection aperture (by admitting that the auxiliary bolt 34 has been fraudulently neutralized). For this purpose a block 41 has been provided, welded on the exterior to the lock 32 or 132 on the wall 1 of the housing, the block 41 preventing the collection head from being approached sufficiently closely for the key to be introduced into the lock.

Another security measure is to make the withdrawal of the head of the collection device impossible without the collection aperture being reclosed first; in effect, the key 65 bolting the head onto the machine means that it is impossible to withdraw the head without having first reclosed the lock, which implies that the slide must have been pushed back into the closed position so that the bolt 31 or 131 may resume its bolted position and the lock in turn is freed.

The invention also provides increased security against an attempt to detach the machine from its support by providing holes, or at least a certain number of bolts 79 (FIG. 1) or screws for fixing the machine onto its support 70 (FIG. 1) to the very inside of the strong-box, this arrangement making the bolts inaccessible even after breaking open the service door, and necessitating a prior opening of the door in order to detach them. This technique for securing the machine to its support can also be used with the second embodiment of the invention.

It is also to be noted that the arrangement of the lock in the interior of the strong-box with only one appropriate hole situated under the machine for the passage of the key, protects its against acts of vandalism, especially against acid attacks which are difficult to carry out upwards.

Of course, the invention is not limited to the embodiment which has just been described by way of example for the issue of parking tickets, and it may be applied to all pre-payment machines in which the introduction of coins allows the distribution of any kind of objects or free access to obtaining any kind of service.

We claim:

1. In a pre-payment machine of the type having a single housing and including therewithin means for evaluating coins and means for distributing objects or access authorization for obtaining services, an improved strong-box for the temporary storage of coins collected by the machine prior to their transfer into a collection device which is removably connectable to the machine, the strong-box comprising:

a receptacle for said coins formed by at least part of the housing and having a collection aperture provided therein communicating with the coin receptacle;

a removable lid disposed within the housing and normally covering the coin receptacle;

a movable seal normally covering the collection aperture, the seal being movable from a position covering the collection aperture to a position uncovering the collection aperture;

locking means associated with the movable seal, the locking means normally securing the seal in a position covering the collection aperture, the locking means being responsive to at least the engagement of the collection device directly to the housing and adjacent to the seal to release the seal and allow movement of the seal from the position covering the collection aperture to the position uncovering the collection aperture; and means for securing the lid to the coin receptacle, the lid securing means being disposed substantially within the coin receptacle and normally engaging the seal when the seal is in the position covering the collection aperture, the lid securing means being responsive to the movement of the seal from the position covering the collection aperture to the position uncovering the collection aperture to release the lid and allow its removal.

2. The machine of claim 1 wherein the seal comprises a slide having an opening which is movable into a position coincident with the collection aperture of the housing.

3. The machine of claim 2 wherein the lid securing means comprises a pin having a groove near one of its ends, and the slide has a notch on its periphery engaging the groove when the collection aperture is covered by the slide.

4. The machine of claim 2 wherein the collection device includes a movable drawer contained therein, a movable stop formed integral with the drawer, and the slide has a recess for removably receiving the movable stop.

5. The machine of claim 1 wherein the locking means comprises a lock provided within the coin receptacle, the lock having a bolt which, in a first position blocks the seal, and lock actuating means associated with the collection device for releasing the lock and enabling movement of the bolt to a position which does not block the seal, the locking means further including a spring bolt normally blocking the seal but responsive to the engagement of the collection device to the housing to release the seal and allow movement thereof.

6. The machine of claim 4 wherein the housing has grooves provided thereon for guiding the collection device into proximity with the collection aperture of the housing.

7. The machine of claim 6 wherein the collection device includes a movable bolt and wherein the grooves of the housing are arranged to cooperate with the movable bolt upon engagement of the collection device so as to maintain the movable stop in a position preventing its introduction into the recess of the slide, whereby unbolting of the movable stop is prevented except when the collection device is engaged in the grooves of the housing.

8. The machine of claim 1, wherein the collection aperture is arranged under the machine in a lower section of the housing.

9. The machine of claim 1 further including means for detachably securing the housing onto a fixed support, wherein the housing securing means are disposed within the strong-box.

10. The machine of claim 1 wherein the lid securing means comprises at least one tab formed as part of the seal which engages at least one opening formed in the lid when the collection aperture is covered by the seal.

11. The machine of claim 10 wherein the lid includes at least one tab which engages at least one opening formed in the coin receptacle when the lid covers the coin receptacle.

12. In a pre-payment machine of the type having a single housing and including therewithin means for evaluating coins and means for distributing objects or access authorizations for obtaining services, an improved strong-box for the temporary storage of coins collected by the machine prior to their transfer into a collection device which is removably connectable to the machine, the strong-box comprising:

a receptacle for said coins formed by at least part of the housing and having a collection aperture provided therein communicating with the coin receptacle;

a removable lid disposed within the housing and normally covering the coin receptacle;

a movable seal normally covering the collection aperture, the seal being movable from a position covering the collection aperture to a position uncovering the collection aperture;

locking means associated with the movable seal, the locking means normally securing the seal in a position covering the collection aperture, the locking means being responsive to at least the engagement of the collection device directly to the housing and adjacent to the seal to release the seal and allow movement of the seal from the position covering the collection aperture to the position uncovering the collection aperture; and means for securing the lid to the coin receptacle, the lid securing means being disposed substantially within the coin receptacle and comprising at least one tab formed as part of the seal which engages at least one opening formed in the lid when the seal is in the position covering the collection aperture, the lid securing means being responsive to the movement of the seal from the position covering the collection aperture to the position uncovering the collection aperture to release the lid and allow its removal.

13. The machine of claim 12 wherein the lid includes at least one tab which engages at least one opening formed in the coin receptacle when the lid covers the coin receptacle.

14. The machine of claim 12 wherein the seal comprises a slide having an opening which is movable into a position coincident with the collection aperture of the housing.

15. The machine of claim 14 wherein the collection device includes a movable drawer contained therein, a movable stop formed integral with the drawer, and the slide has a recess for removably receiving the movable stop.

16. The machine of claim 12 wherein the locking means comprises a lock provided within the coin receptacle, the lock having a bolt which, in a first position blocks the seal, and lock actuating means associated with the collection device for releasing the lock and enabling movement of the bolt to a position which does not block the seal, the locking means further including a spring bolt normally blocking the seal but responsive to the engagement of the collection device to the housing to release the seal and allow movement thereof.

17. The machine of claim 15 wherein the housing has grooves provided thereon for guiding the collection device into proximity with the collection aperture of the housing.

18. The machine of claim 17 wherein the collection device includes a movable bolt and wherein the grooves of the housing are arranged to cooperate with the movable bolt upon engagement of the collection device so as to maintain the movable stop in a position preventing its introduction into the recess of the slide, whereby unbolting of the movable stop is prevented except when the collection device is engaged in the grooves of the housing.

19. The machine of claim 12 wherein the collection aperture is arranged under the machine in a lower section of the housing.

20. The machine of claim 12 further including means for detachably securing the housing onto a fixed support, wherein the housing securing means are disposed within the strong-box.

* * * * *